United States Patent [19]

Maier et al.

[11] Patent Number: 4,650,946

[45] Date of Patent: Mar. 17, 1987

[54] CIRCUIT BREAKER WITH STOP PLATE FOR CONTACT ARM

[75] Inventors: Alfred E. Maier, Chippewa Township, Beaver County; David L. Haggerty, Pittsburgh, both of Pa.

[73] Assignee: Westinghouse Electric Corp., Pittsburgh, Pa.

[21] Appl. No.: 802,557

[22] Filed: Nov. 27, 1985

[51] Int. Cl.[4] ..... H01H 3/60

[52] U.S. Cl. ..... 200/288; 200/153 G; 335/16

[58] Field of Search ..... 200/153 G, 288, 301; 335/16, 195

[56] References Cited

U.S. PATENT DOCUMENTS

| | | | |
|---|---|---|---|
| 3,492,609 | 1/1970 | Murai et al. | 335/16 |
| 4,071,836 | 1/1978 | Cook et al. | 335/195 |
| 4,259,651 | 3/1981 | Yamat | 335/195 |
| 4,470,027 | 9/1984 | Link et al. | 335/16 |
| 4,563,557 | 1/1986 | Leone | 200/153 G |

*Primary Examiner*—Stephen Marcus
*Assistant Examiner*—Renee S. Luebke
*Attorney, Agent, or Firm*—L. P. Johns

[57] ABSTRACT

A circuit breaker with a shock-absorbing mechanism characterized by a movable contact arm operable between open and closed positions of separable contacts, a stop member for stopping movement of the contact arm which member is integral with a housing for the circuit breaker, and a shock-absorbing plate on the member for spreading the energy released when the contact arm collides with the stop member.

4 Claims, 4 Drawing Figures

CIRCUIT BREAKER WITH STOP PLATE FOR CONTACT ARM

BACKGROUND OF THE INVENTION

1. Field of the Invention

This invention relates generally to single or multiple-pole circuit breakers, and more particularly, to a stop structure for absorbing and distributing the collision energy generated when the movable contact carrying arm moves to a contact open position.

2. Description of the Prior Art

When a high short-circuit current flows into the stationary contact of a circuit breaker and back into the moving contact, it causes a large repulsion force that propels a moving contact arm to open rapidly. This provides current limiting action to the circuit breaker. However, the moving contact arm must be stopped at the end of its travel. In the past, rubber-type material has been used for this function, but has caused certain disadvantages including high cost, large thickness, rebound of contact arm, and sticking of the hot contact arm to the rubber.

SUMMARY OF THE INVENTION

In accordance with this invention a circuit breaker is provided that comprises an electrically insulating housing containing a circuit breaker having stationary and movable contacts separable between open and closed positions. The movable contact is supported on a contact arm that is pivotally mounted for movement between said positions. The molded insulating housing includes integral stop means for stopping movement of the contact arm and a shock-absorbing semi-flexible plate covers the stop means for spreading the energy released when the contact arm collides with the stop means to prevent damage to the stop means as well as to prevent rebound of the contact arm.

DESCRIPTION OF THE PREFERRED EMBODIMENT

Figure 1:
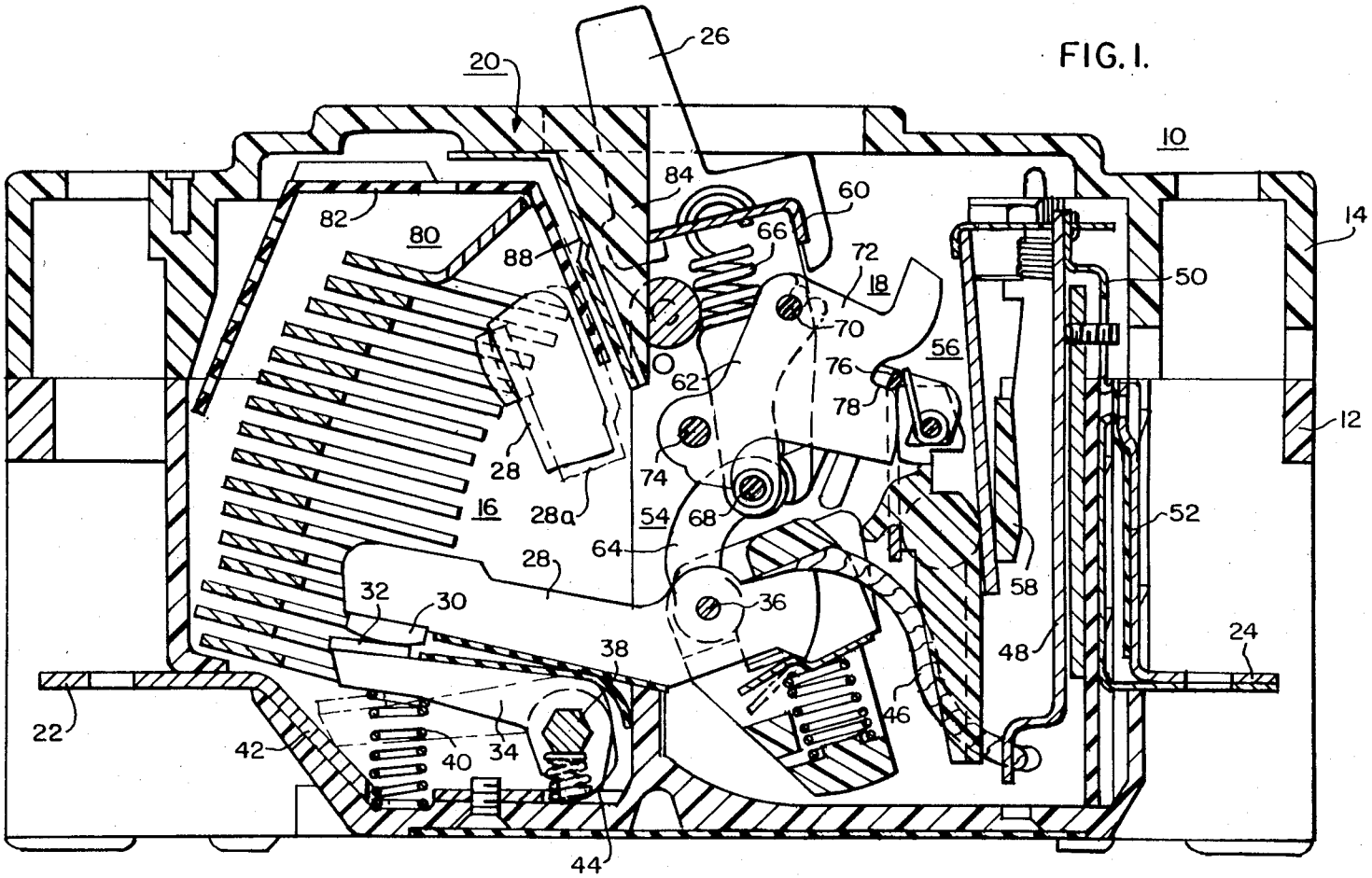
FIG. 1 is a vertical sectional view through a circuit breaker taken on the line I—I of FIG. 2.

A circuit breaker is generally indicated at 10 in FIG. 1 and it comprises a molded casing or housing 12 having a cover 14, a circuit breaker structure generally indicated at 16, an operating mechanism 18, and shock absorbing means 20. The principles of the present invention disclosed herein are equally applicable to single phase or other polyphase circuit breakers and to both AC circuit breakers as well as DC circuit breakers.

Figure 2:
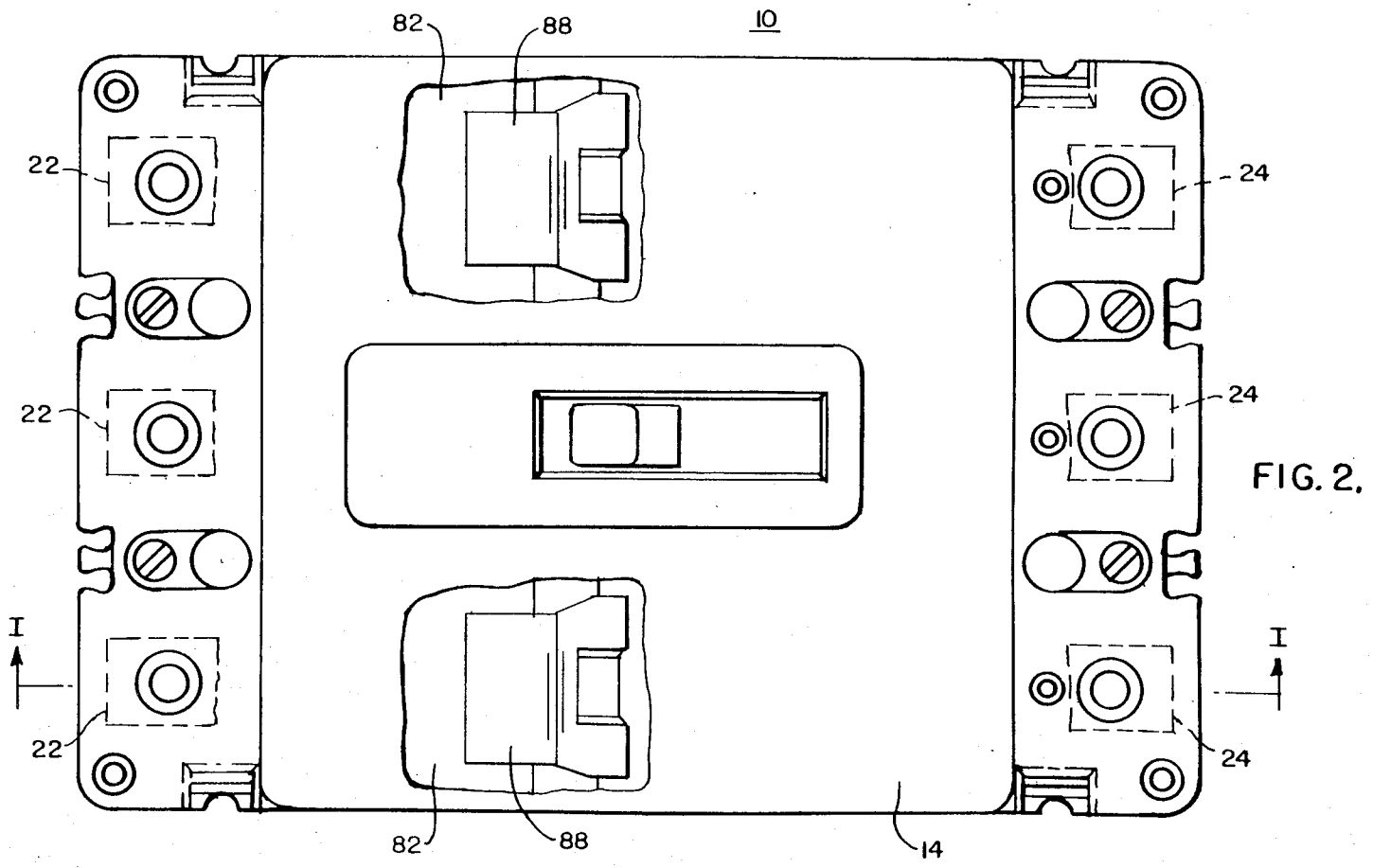
FIG. 2 is a top plan view of a molded case circuit breaker, with portions broken away.

The housing 12 and the cover 14 are comprised of molded insulating material, such as an epoxy, which when fitted together (FIG. 1) provide an interior chamber in which the operating parts including the structure 16 and mechanism 18 are contained. As shown in FIG. 2 a plurality of similar line terminals 22 are provided at one end of the circuit breaker 10 and a corresponding plurality of load terminals 24 and provided at the opposite end thereof. These terminals are used to serially electrically connect the circuit breaker 10 into a three-phase electrical circuit for protecting a three-phase electrical system.

The circuit breaker 10 includes a manually operated handle 26 (FIG. 1) by which the circuit breaker is manually operated between closed and open positions. In the closed position a movable contact arm 28 carrying a movable contact 30, is shown in solid line position with the contact 30 in engagement with a contact 32 which is carried on a lower contact arm 34. The upper movable contact arm 28 is pivotally mounted at 36 and the lower movable contact arm 34 is pivoted at 38. A coil spring 40 biases the arm 34 upwardly in the closed circuit position with the upper movable contact arm 28. Accordingly, a circuit through the circuit breaker 10 extends from the line terminal 22 through a conductor 42 to a lower end 44 of and through the arm 34, through the contacts 32, 30, the movable contact arm 28, a shunt 46, a bimetal 48, through interconnected connectors 50, 52 to the load terminals 24. In the open position of the circuit breaker 10 the upper movable contact arm 28 is in the broken line position **28*a* (FIG. 1**).

The circuit breaker operating mechanism 18 includes an over-center toggle mechanism 54, a trip device 56, a molded cross-bar 58, and a yoke 60.

The toggle mechanism 54 comprises a pair of upper toggle links 62, a pair of lower toggle links 64, a pair of toggle springs 66. A toggle spring pin 68 pivotally connects corresponding ends of the upper and lower toggle links 62, 64. The upper end of the upper toggle links 62 are pivoted on a link pin 70 which is fixedly mounted on a cradle 72 which is rotatable about a cradle support pin 74. Accordingly, the contacts 30, 32 are opened when the handle 26 is rotated in the clockwise direction from that shown in FIG. 1, which causes the yoke 60 to move the line of action of the toggle springs 66 to the right of the link pin 70, whereupon the springs cause a collapse of the toggle links 62, 64, thereby moving the contact arm to the open (broken-line) position **28*a*, in a conventional manner. Contacts 30, 32 are closed by counter-clockwise movement of the handle 26 to cause the axis of the springs 66 to move to the left of the link pin 70, whereby the toggle spring pin 68 moves the upper and lower toggle links 62, 64** to their extended positions in a conventional manner.

The circuit breaker 10 is retained in the closed circuit condition by the cradle 72. However, the trip device 56 is used for tripping the circuit breaker through the cradle 72 and the toggle mechanism 54 upon the occurrence of an overload condition or a short circuit or fault current condition. The trip device 56 is shown more particularly in the U.S. Pat. Application Ser. No. 655,955, filed Sept. 28, 1984, now U.S. Pat. No. 4,563,557 which is incorporated by reference. Generally, the trip device 56 comprises the bimetal strip 48, the cross-bar 58, and a latch plate 76 which when actuated in series causes the latch plate 76 to disengage from a latch surface 78 to trip the cradle 72.

When an abnormal current condition exists, such as an overload, short circuit, or fault current, it flows through the contacts 30, 32 causing the moving contact arm 28 to open rapidly by the repulsion action of the current to the broken line position 28a (FIG. 1). To extinguish any arc existing between the contacts 30, 32 during opening of the circuit, an arc chute 80 is provided as a conventional part of the circuit breaker and is not further discussed herein except to indicate that an electrical insulation barrier 82 (FIG. 3) is provided above the arc chute for containing and directing any arc gases that occur in the arc chute.

In accordance with this invention the cover 14 (FIG. 3) includes a barrier or stop 84 for limiting movement of the arm 28. The barrier 84 is preferably an integral part of the molded cover 14. The barriers 84 are provided only in the outer phase chamber of the circuit breaker 10 as shown in the broken-away portions of FIG. 2. No barrier is included in the center phase, because it would interfere with operation of the circuit breaker structure 16.

To avoid damage to the barrier or stop 84 resulting from repeated collisions by the moving contact arm 28, a stop plate 86 is provided on the side of the barrier or stop 84 facing the content arm 28. The stop plate 86 is part of the shock absorbing means 20 and is retained in place against the barrier or stop 84 and the undersurface of the cover 14 by adhesive means, such as gluing, or by ears which can fit into holes of the arc chute sides.

Figure 3:
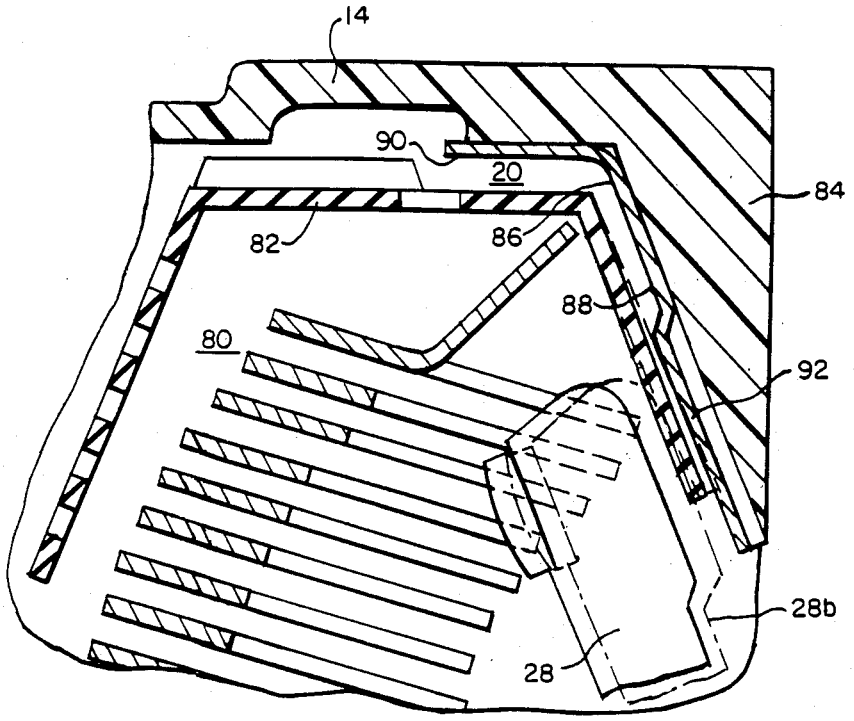
FIG. 3 is an enlarged, fragmentary view of a portion of the circuit breaker shown in FIG. 1.
Figure 4:
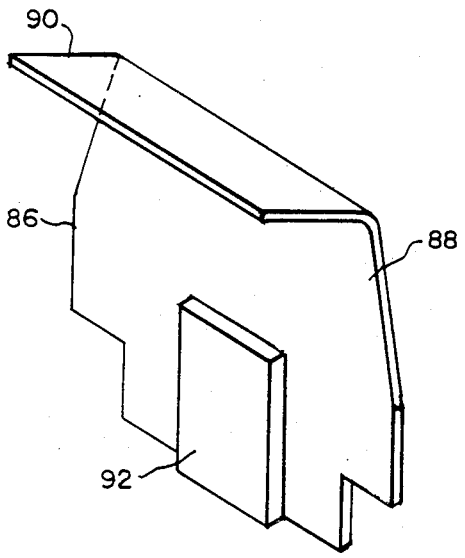
FIG. 4 is an isometric view of the stop plate in accordance with this invention.

As shown more particularly in FIG. 4 the stop plate 86 is a plate-like member fabricated from sheet material, such as metal, and includes a body portion 88 and an out-turned flange 90 which are preferably secured to the barrier 84 and cover 14, respectively (FIG. 3). The body portion 88 preferably includes a raised surface portion 92 which is preferably fabricated by stamping. The raised surface portion 92 (FIG. 4) is aligned with the path of travel of the moving contact arm 28 and the force of impact occurring between the arm and the raised surface portion is transmitted through the planar surface of the body portion 88 so as to minimize the otherwise destructive force of the arm as it strikes the barrier or stop 84.

As shown in FIG. 3 when the movable contact arm 28 strikes the raised surface portion 92, it is disposed in a broken line position **28*b* with the barrier 82 between the arm and portion 92**.

Accordingly, the circuit breaker is provided with a stop plate comprising a barrier of a fibrous material and a metal plate secured to the molded cover of a circuit breaker to absorb and distribute the shock of the contact arm being blown open under high short circuit conditions, thereby preventing ultimate breakdown of the molded barrier due to impact of the movable contact arm.

What is claimed is:

1. A circuit breaker comprising:

(a) an electrically insulating housing, (b) a circuit breaker within the housing and including first and second contacts operable between open and closed positions;

(c) a contact arm for supporting the second contact and pivotally mounted for movement of the second contact between said positions;

(d) a circuit breaker operating mechanism releasable to effect movement of the contact arm;

(e) stop means within and comprising a portion of the housing for stopping movement of the contact arm during opening of the contacts;

(f) shock absorbing means mounted on the stop means for absorbing energy released by the contact arm;

(g) the shock absorbing means including a semi-rigid plate covering a surface area of the stop means greater than the striking surface area of contact arm so as to spread the striking force of the contact arm over a larger surface of the stop means than the area otherwise struck by the contact arm; and (h) the plate including a planar surface having a raised surface portion which raised surface portion is in alignment with the contact arm so that any force of impact occurring between the contact arm and the raised surface portion is transmitted through the planar surface to the stop means.

2. The circuit breaker of claim 1 in which the plate is sheet metal.

3. An electrical circuit breaker comprising:

(a) an electrically insulating housing;

(b) a circuit breaker within the housing and including separable contacts including one contact movable between open and closed positions;

(c) operating means for moving said one contact between the open and closed positions;

(d) the housing including a barrier for limiting movement of the one contact;

(e) shock absorbing means mounted on the barrier and comprising a semi-rigid plate for absorbing energy from the moving contact; and (f) the semi-rigid plate including a planar surface on the barrier and an integral surface portion out of alignment with the planar surface and in alignment with the moving contact.

4. The circuit breaker of claim 3 in which the semi-rigid plate is sheet metal.

* * * * *